US010428496B1

(12) United States Patent
Lu et al.

(10) Patent No.: US 10,428,496 B1
(45) Date of Patent: Oct. 1, 2019

(54) KITCHEN FAUCET MOUNTING STRUCTURE

(71) Applicant: XIAMEN EASO CO., LTD., Xiamen, Fujian (CN)

(72) Inventors: Haitao Lu, Xiamen (CN); Ximin Chen, Xiamen (CN); Yuebin Yang, Xiamen (CN); Zhen Li, Xiamen (CN)

(73) Assignee: XIAMEN EASO CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/970,899

(22) Filed: May 4, 2018

(51) Int. Cl.
*E03C 1/04* (2006.01)

(52) U.S. Cl.
CPC ..... *E03C 1/0401* (2013.01); *E03C 1/0403* (2013.01); *Y10T 137/598* (2015.04)

(58) Field of Classification Search
CPC ... E03C 1/0401; E03C 1/0403; Y10T 137/598
See application file for complete search history.

(56) References Cited

U.S. PATENT DOCUMENTS 5,518,019 A * 5/1996 Clare ..... E03C 1/023 137/119.01
2016/0177549 A1* 6/2016 Tzeng ..... E03C 1/0403 137/801
2016/0178094 A1* 6/2016 Tzeng ..... F16K 19/006 251/148
2019/0085538 A1* 3/2019 Chang ..... F16K 11/085

* cited by examiner

*Primary Examiner* — Eric Keasel
*Assistant Examiner* — Kevin R Barss
(74) *Attorney, Agent, or Firm* — Chun-Ming Shih

(57) ABSTRACT

A kitchen faucet mounting structure includes a faucet body, a pipe connector, and a fixing assembly. The faucet body is connected to an upper portion of the pipe connector. The fixing assembly includes an upper casing, a press block, a return C-shaped ring, and a lower casing. Through the cooperation of the upper casing, the press block and the lower casing, the fixing assembly and the pipe connector can be assembled and fixed quickly. Through the cooperation of the return C-shaped ring and the press block, the fixing assembly and the pipe connector can be disassembled quickly.

10 Claims, 11 Drawing Sheets

KITCHEN FAUCET MOUNTING STRUCTURE

BACKGROUND OF THE INVENTION

1. Field of the Invention

The present invention relates to a faucet mounting structure, and more particularly to a kitchen faucet mounting structure which can be installed easily.

2. Description of the Prior Art

In general, a kitchen faucet is installed close to the wall. Due to the shape of the kitchen stainless steel sink, the space under the countertop for locking the faucet is limited. Most faucets and basins are screwedly connected. According to the traditional operation to lock the nut on the bolt, the nut is rotated from the lower end of the bolt. The effective length of the bolt depends on the thickness of the countertop, which determines the length of the nut to be locked. The space under the countertop is quite narrow, and the operation space is extremely limited. Thus, to lock or unlock the nut takes time and energy. The installation efficiency is low. It is difficult to align the starting point of the screw thread.

Accordingly, the inventor of the present invention has devoted himself based on his many years of practical experiences to solve these problems.

SUMMARY OF THE INVENTION

The primary object of the present invention is to provide a kitchen faucet mounting structure, which is simple in structure and can be assembled and disassembled quickly and easily.

In order to achieve the aforesaid object, the kitchen faucet mounting structure of the present invention comprises a faucet body, a pipe connector, and a fixing assembly. The faucet body is connected to an upper portion of the pipe connector. A lower portion of the pipe connector has an external thread. The fixing assembly includes an upper casing, a press block, a return C-shaped ring, and a lower casing. The upper casing has a central through hole for the pipe connector to pass therethrough. The upper casing further comprises at least one guide post. The guide post has a first inclined surface. The press block had at least one opening. The press block has an internal thread in cooperation with the external thread of the pipe connector. An upper portion of the press block has a second inclined surface in cooperation with the first inclined surface. The press block further has an annular engaging groove for mounting the return C-shaped ring. An upper portion of the lower casing is provided with a trough extending downwards from a top surface thereof. The press block is mounted in the trough. An inner wall of the trough is provided with at least one engaging post. The press block is provided with a guide hole corresponding to the engaging post.

Preferably, a bottom surface of the upper casing is provided with a plurality of limiting ribs. The guide post is disposed between the limiting ribs and the through hole. A top end of the lower casing is provided with at least one guide protrusion. A top end of the guide protrusion is inserted between two of the limiting ribs on the bottom surface of the upper casing.

Preferably, the upper casing has at least two engaging slots. A top end of the lower casing is provided with engaging hooks in cooperation with the engaging slots.

Preferably, the fixing assembly further comprises a return spring. One end of the return spring leans against a bottom end of the upper casing, and another end of the return spring leans against the lower casing.

Preferably, a top end of the lower casing is provided with at least one elastic arm. An outer periphery of a top end of the elastic arm has a return inclined surface. The upper casing is provided with an oblique protrusion in cooperation with the return inclined surface of the elastic arm.

Preferably, the trough of the lower casing is provided with at least one boss corresponding to the opening of the press block. The boss has guide surfaces toward two sides of the press block.

Preferably, a bottom end of the press block has at least one L-shaped guide notch. The trough of the lower casing is provided with at least one guide raised block corresponding to the guide notch of the press block.

Preferably, the press block has two openings. The two openings divide the press block into a left press block and a right press block. Each of the left press block and the right press block is provided with the guide hole.

Preferably, the top end of the lower casing has a stop wall in cooperation with a bottom surface of the upper casing. The stop wall is provided with the engaging hooks corresponding in position to the engaging slots of the upper casing. The engaging slots each have a certain height so that the locking hooks can move up and down within the respective engaging locking slots.

Preferably, the first inclined surface of the guide post is gradually enlarged downwards and outwards from one side of the through hole. The second inclined surface of the press block is gradually tapered from an outer periphery of the upper portion of the press block.

Accordingly, the present invention achieves rapid assembly and fixation of the fixing assembly and the pipe connector through the cooperation of the upper casing, the press block and the lower casing, and then uses the cooperation of the return C-shaped ring and the press block to achieve the quick disassembly of the fixing assembly and the pipe connector. When assembled, only the fixing assembly needs to be aligned with the pipe connector and the fixing assembly is pushed upwards to reach the countertop. The first inclined surface of the press block of the fixing assembly and the second inclined surface of the upper casing mutually are pressed against each other to compress the press block inwardly so that the internal thread of the press block meshes with the external thread of the pipe connector. After that, the fixing assembly is rotated one turn, so that the fixing assembly and the pipe connector are screwedly connected together. When disassembled, only the fixing assembly needs to be rotated reversely one turn, and the screw connection between the pipe connector and the fixing assembly is released. Under the action of the return C-shaped ring, the press block bounces outwards and the fixing assembly can be quickly disassembled. The present invention realizes rapid assembly and disassembly of the faucet body through a simple structure.

DETAILED DESCRIPTION OF THE PREFERRED EMBODIMENTS

Figure 1:
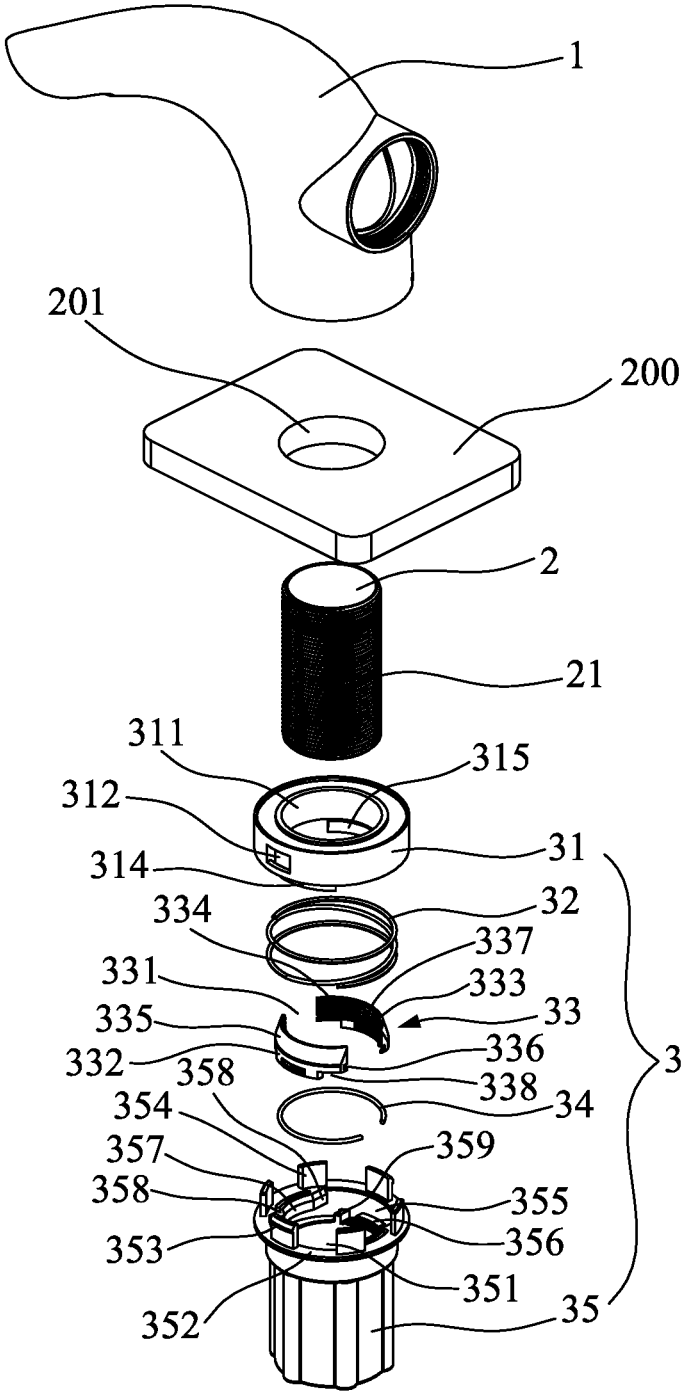
FIG. 1 is an exploded view in accordance with a first embodiment of the present invention.
Figure 1A:
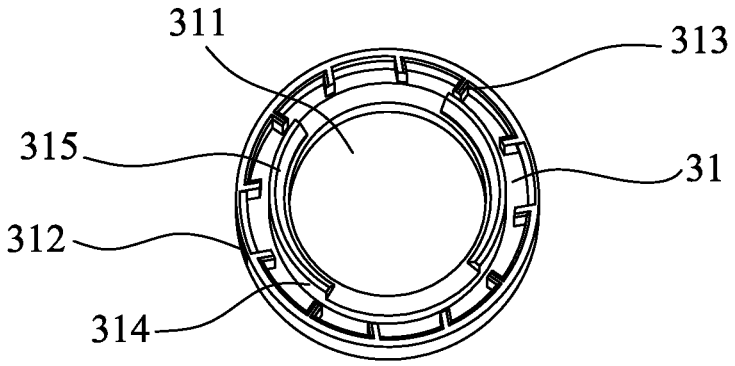
FIG. 1A is a bottom view of the upper casing in accordance with the first embodiment of the present invention.
Figure 2:
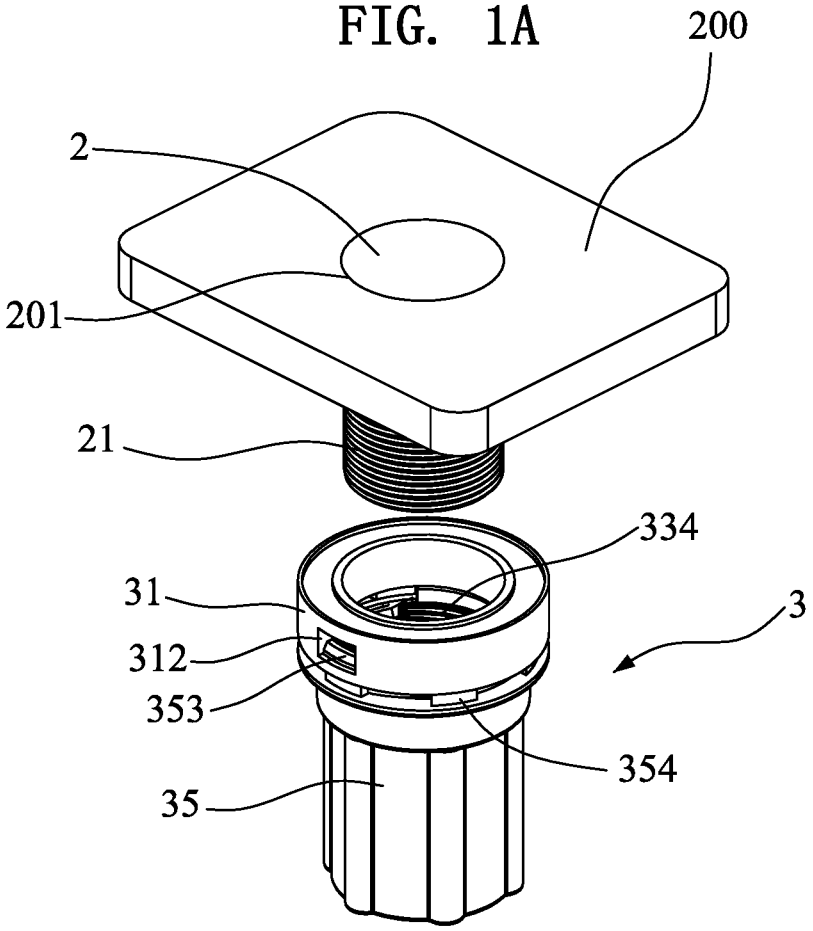
FIG. 2 is a schematic view showing the installation of the fixing assembly and the pipe connector in accordance with the first embodiment of the present invention.
Figure 3:
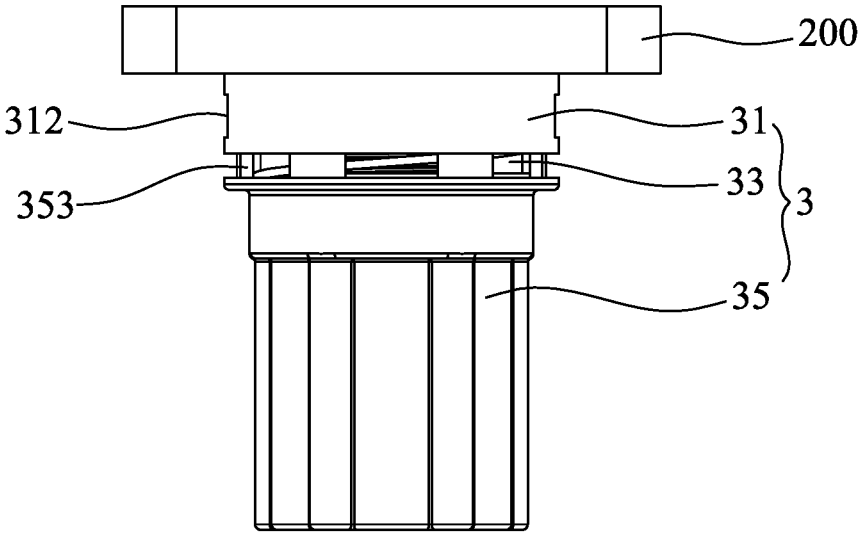
FIG. 3 is a front view showing the fixing assembly mounted to the pipe connector in accordance with the first embodiment of the present invention.
Figure 4:
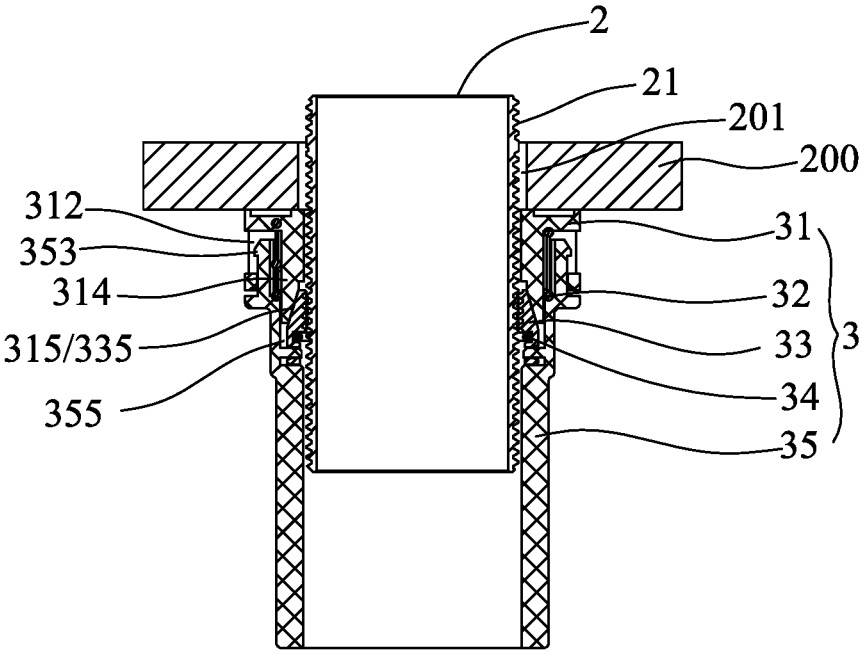
FIG. 4 is a sectional view of FIG. 3.
Figure 5:
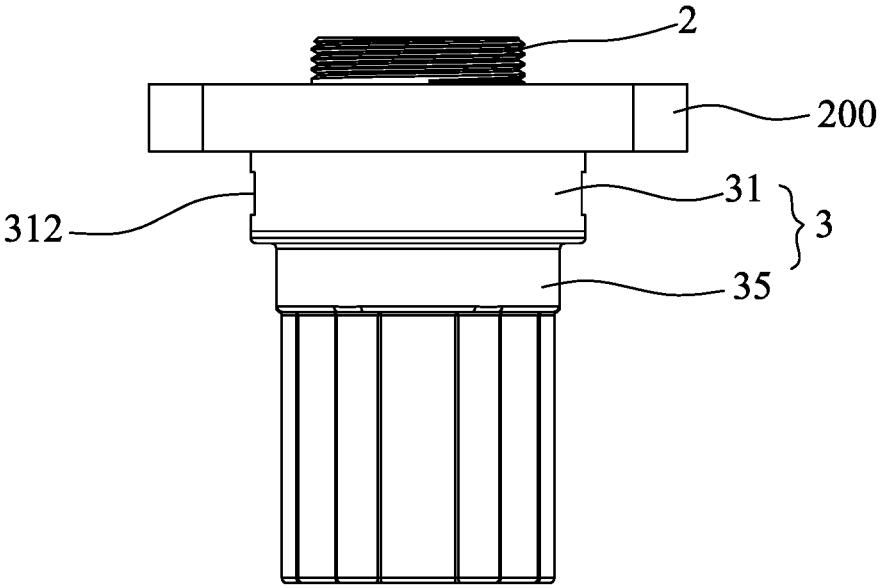
FIG. 5 is a front view showing that the fixing assembly and the pipe connector are tightened in accordance with the first embodiment of the present invention.
Figure 6:
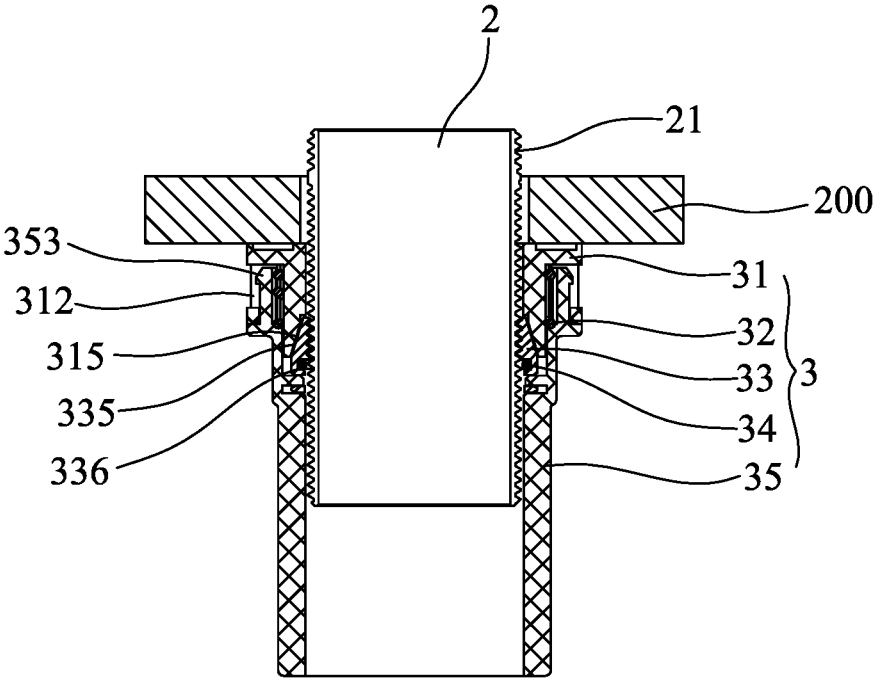
FIG. 6 is a sectional view of FIG. 5.
Figure 7:
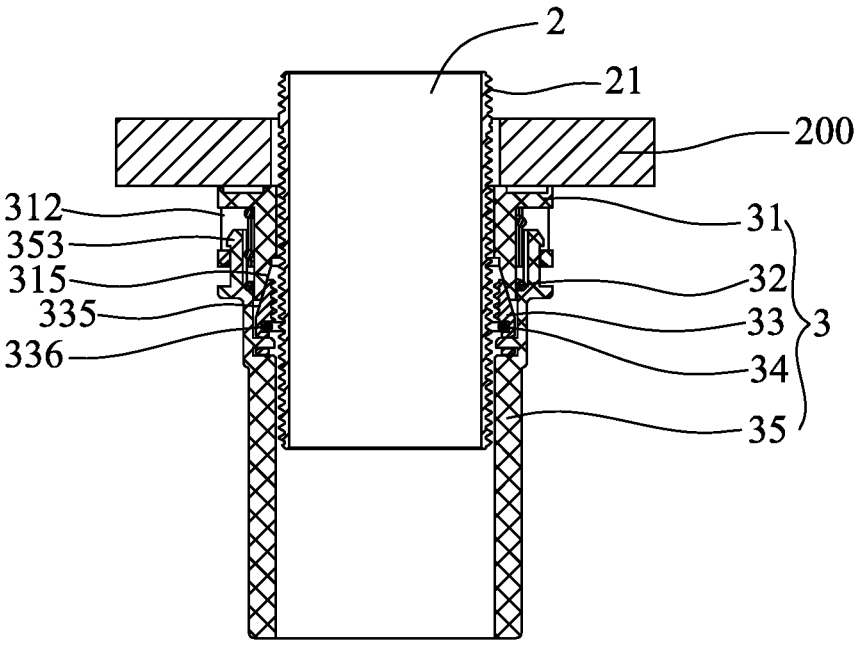
FIG. 7 is a sectional view showing that the fixing assembly and the pipe connector are untightened in accordance with the first embodiment of the present invention.
Figure 8:
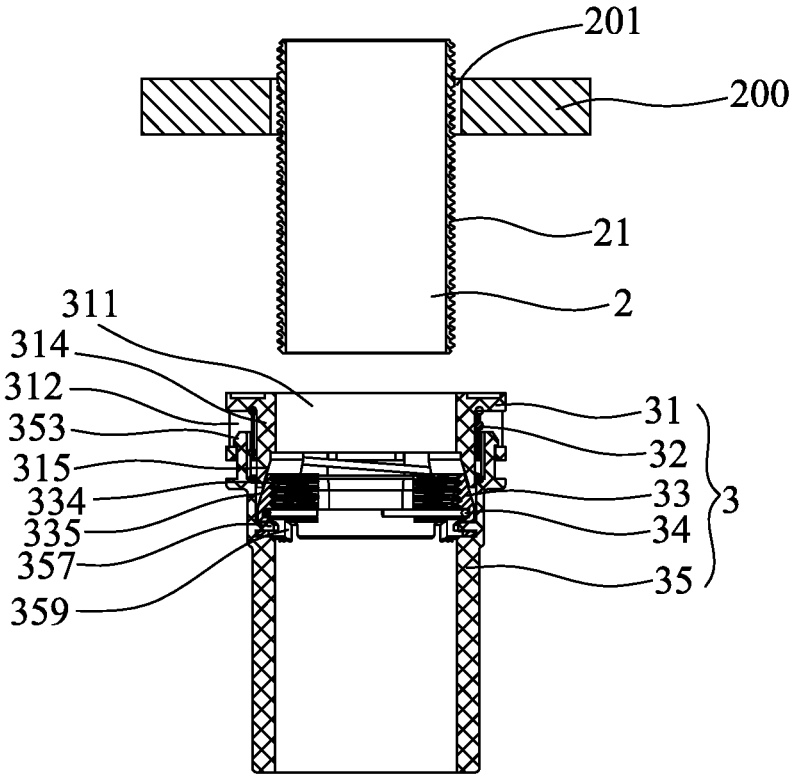
FIG. 8 is a sectional view showing that the fixing assembly is detached from the pipe connector in accordance with the first embodiment of the present invention.
Figure 9:
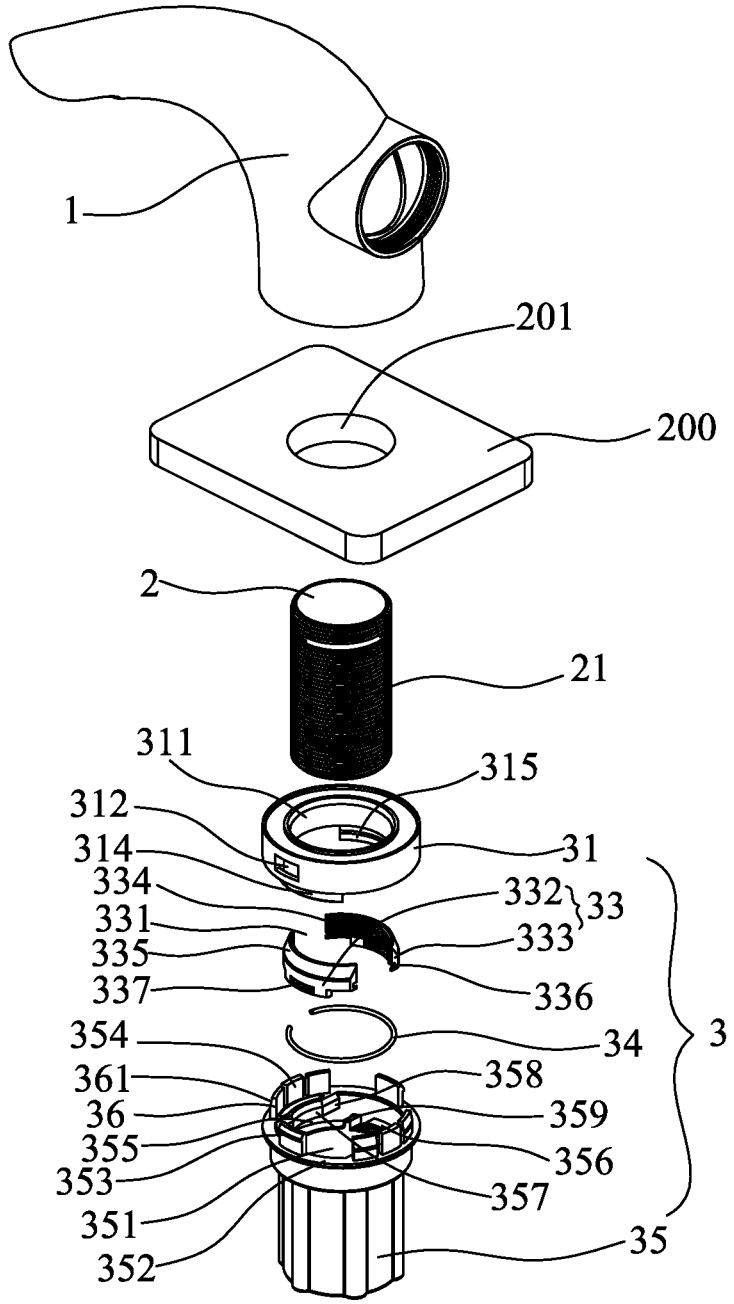
FIG. 9 is an exploded view in accordance with a second embodiment of the present invention.
Figure 9A:
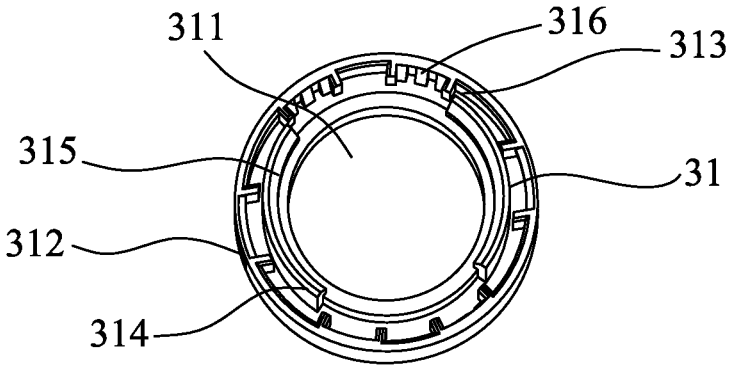
FIG. 9A is a bottom view of the upper casing in accordance with the second embodiment of the present invention.
Figure 10:
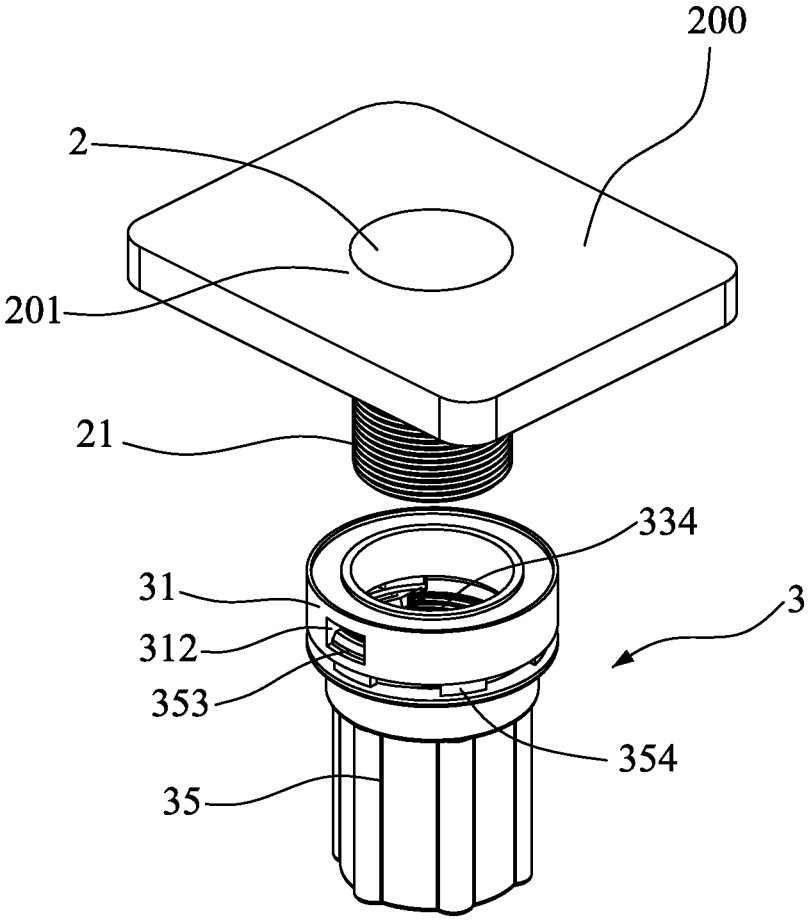
FIG. 10 is a schematic view showing the installation of the fixing assembly and the pipe connector in accordance with the second embodiment of the present invention.
Figure 11:
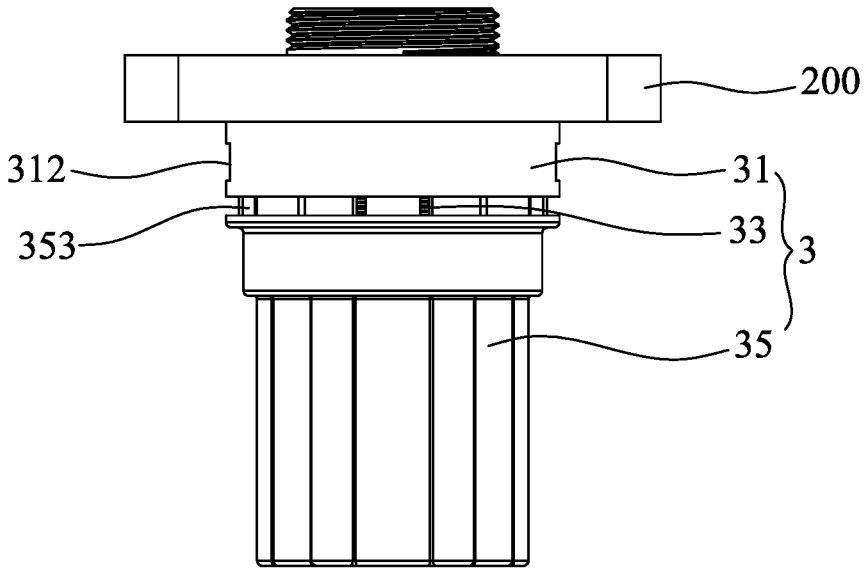
FIG. 11 is a front view showing the fixing assembly mounted to the pipe connector in accordance with the second embodiment of the present invention.
Figure 12:
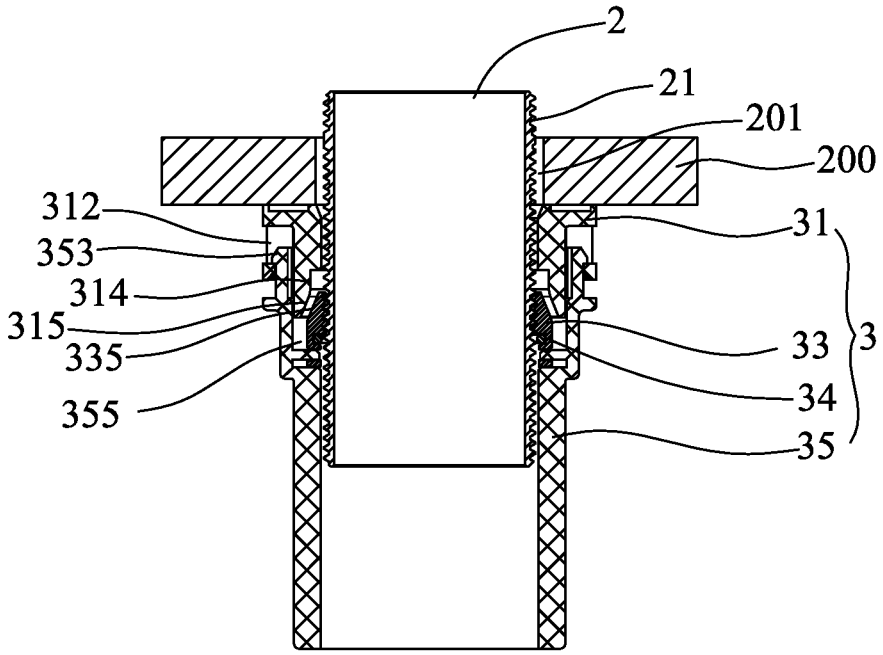
FIG. 12 is a sectional view of FIG. 11.

Embodiments of the present invention will now be described, by way of example only, with reference to the accompanying drawings.

As shown in FIG. 1 to FIG. 17, the present invention discloses a kitchen faucet mounting structure, which comprises a faucet body 1, a pipe connector 2, and a fixing assembly 3. FIGS. 1 to 8 illustrate a first embodiment of the present invention. FIGS. 9 to 17 illustrate a second embodiment of the present invention. The difference between the two embodiments is the structural design of the fixing assembly 3.

The faucet body 1 is mounted on a countertop 200. The faucet body 1 is screwedly connected to the pipe connector 2.

The pipe connector 2 is fitted in a mounting hole 201 of the mounting countertop 200. The upper portion of the pipe connector 2 is connected to the faucet body 1, and the lower portion of the pipe connector 2 is inserted into the mounting hole 201 of the mounting countertop 200. There are a variety of ways for the connection between the pipe connector 2 and the faucet body 1. For example, as shown in the figures, an internal thread is provided on the inner wall of the bottom of the valve body 1, and the outer periphery of the pipe connector 2 has an external thread 21 corresponding to the internal thread. The pipe connector 2 and the faucet body 1 are connected and fixed together through the screw threads. The faucet body 1 and the pipe connector 2 can be directly connected by welding, or the faucet body 1 and the pipe connector 2 are connected together through a snap-fit structure.

As shown in FIG. 1 to FIG. 8, a first embodiment of the present invention is shown. The fixing assembly 3 includes an upper casing 31, a return spring 32, a press block 33, a return C-shaped ring 34, and a lower casing 35.

The upper casing 31 has a central through hole 311 for the pipe connector 2 to pass therethrough. The outer periphery of the upper casing 31 has at least two engaging slots 312 spaced at equal intervals. The bottom surface of the upper casing 31 may be provided with a plurality of limiting ribs 313. The upper casing 31 further comprises a guide post 314. The guide post 314 protrudes from the bottom surface of the upper casing 31. The guide post 314 is disposed between the limiting ribs 313 and the through hole 311. The guide post 314 has a second inclined surface 315 that is gradually enlarged outwards and downwards from one side of the through hole 311.

One end of the return spring 32 is disposed between the limiting ribs 313 and the guide post 314 of the upper casing 31. Another end of the return spring 32 leans against the lower casing 35.

The press block 33 has at least one opening 331 so that the press block 33 can be opened and closed relative to the opening 331. In this embodiment, the press block 33 has two openings 331. The two openings 331 divide the press block 33 into two separate components, a left press block 332 and a right press block 333. The press block 33 has an internal thread 334 cooperating with the external thread 21 of the pipe connector 2. The upper periphery of the upper portion of the press block 33 has a first inclined surface 335 that is gradually tapered upwards. An annular engaging groove 336 is provided on the internal thread 34 of the press block 33 for mounting the return C-shaped ring 34. Each of the left press block 332 and the right press block 333 is formed with a guide hole 337. The bottom end of the press block 33 has at least one L-shaped guide notch 338.

The return C-shaped ring 34 is an annular structure having an opening 341 so that it can be compressed by a force. The return C-shaped ring 34 is disposed in the annular engaging groove 336 of the press block 33.

The lower casing 35 has a central through hole 351 for the pipe connector 2 to pass therethrough. The top end of the lower casing 35 has a stop wall 352 in cooperation with the bottom surface of the upper casing 31. The stop wall 352 is provided with engaging hooks 353 corresponding in position to the engaging slots 312 of the upper casing 31 and mated with the engaging slots 312. The engaging slots 312 each have a certain height so that the locking hooks 353 can move up and down within the respective engaging locking slots 312. The stop wall 352 is further provided with at least one guide protrusion 354. When assembled, the top end of the guide protrusion 354 is inserted between the two limiting ribs 313 on the bottom surface of the upper casing 31. The upper portion of the lower casing 35 is provided with a trough 355 extending downward from a top surface thereof. The press block 33 is mounted in the trough 355. The inner wall of the trough 355 is provided with an engaging post 356 corresponding to the guide hole 337 of the press block 33. The trough 355 is further provided with at least one boss 357 corresponding to the opening 331 of the press block 33. The boss 357 has guide surfaces 358 toward two sides of the press block 33. The trough 355 of the lower casing 35 is provided with at least one guide raised block 359 corresponding to the guide notch 338 of the press block 33.

When the fixing assembly 3 is assembled, the engaging posts 356 of the lower casing 35 are inserted in the guide holes 337 of the left press block 332 and the right press block 333, so that the press blocks 33 are fixed in the trough 355 of the lower casing 35. The L-shaped guide notch 338 of the press block 33 is mated with the guide raised block 359 of the lower casing 35. Both ends of the left press block 332 and the right press block 333 abut against the guide surfaces 358 of the boss 357 of the lower casing 35. The return C-shaped ring 34 is mounted in the annular engaging groove 336 of the press block 33. The top end of the return spring 32 is mounted between the limiting ribs 313 and the guide post 314 of the upper casing 31. The lower casing 35 with the return C-shaped ring 34 and the press block 33 is mounted to the upper casing 31 with the return spring 32. The engaging hooks 353 of the lower casing 35 are engaged in the engaging slots 312 of the upper casing 31, so that the upper casing 31 and the lower casing 35 are connected together. The bottom end of the return spring 32 leans against the trough 355 of the lower casing 35.

When the present invention is assembled, the faucet body 1 and the pipe connector 2 are screwed together. The bottom end of the pipe connector 2 passes through the mounting hole 201 of the countertop 200, and the assembled fixing assembly 3 is fitted to the lower end of the pipe connector 2 so that the pipe connector 2 passes through the through holes of the upper casing 31 and the lower casing 35 in sequence. The fixing assembly 3 is moved up until the top of the upper casing 31 leans against the bottom surface of the countertop 200. When the top surface of the upper casing 31 abuts against the countertop 200, the lower casing 35 is further pushed upwards. The second inclined surface 315 of the upper casing 31 presses the first inclined surface 335 of the press block 33 and compresses the return spring simultaneously. When the second inclined surface 315 and the first inclined surface 334 are pressed, the press block 33 will be compressed inwards. The arrangement of the guide surfaces 358 and the guide raised block 359 provided on the lower casing 35 enables the press block 33 to be compressed more smoothly. The compression of the press block 33 also causes the compression of the return C-shaped ring 34 to store energy. Under the action of the second inclined surface 315 of the upper casing 31, the press block 33 overcomes the action of the return C-shaped ring 34 to mesh with the pipe connector 2. After one rotation, the press block 33 is fully connected to the pipe connector 2 to achieve a quick installation, and the return C-shaped ring 34 is further deformed.

When the present invention is disassembled, only the fixing assembly 3 is reversely rotated, the locked state of the press block 33 and the pipe connector 2 is released. The upper casing 31 is detached from the countertop 200. Under the action of the return spring 32, the press force on the press block 33 is eliminated. The press block 33 is released to bounce toward both sides under the action of the return C-shaped ring 34, so that the fixing assembly 3 can be quickly removed to complete the disassembly.

Figure 13:
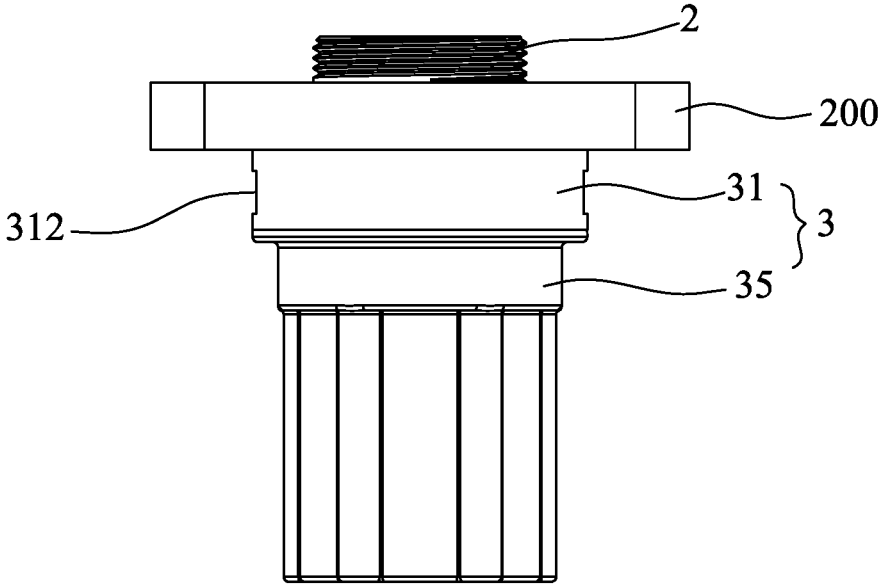
FIG. 13 is a front view showing that the fixing assembly and the pipe connector are tightened in accordance with the second embodiment of the present invention.
Figure 14:
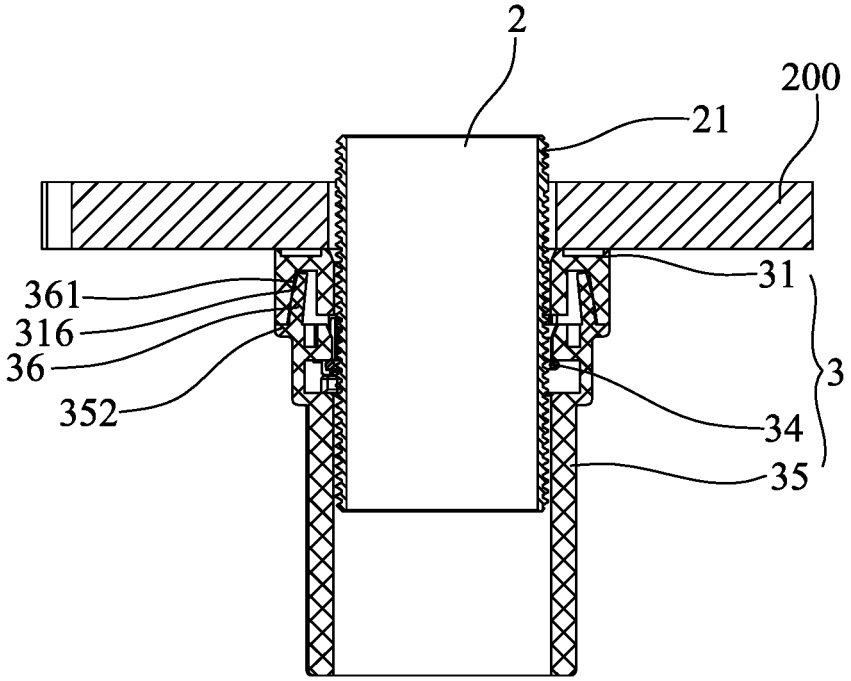
FIG. 14 is a sectional view of FIG. 13.
Figure 15:
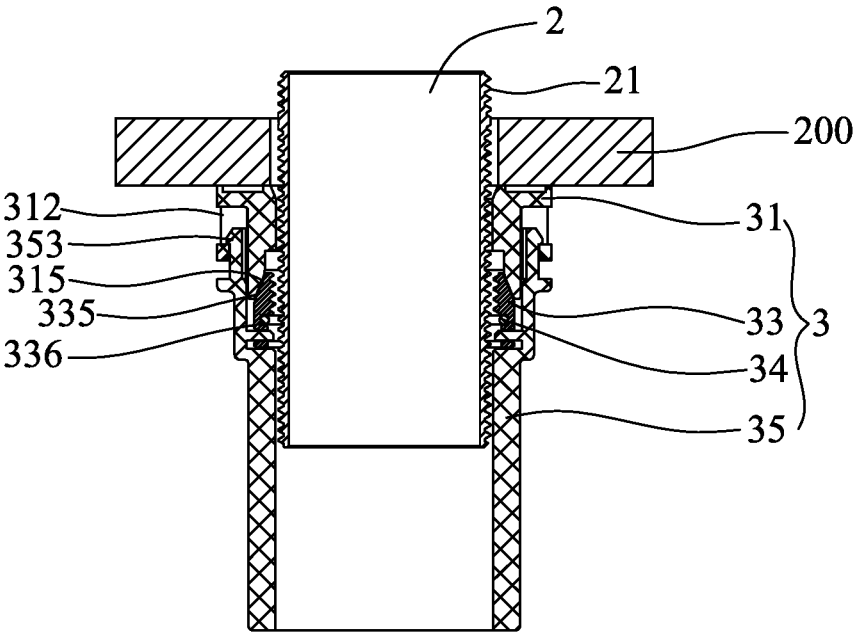
FIG. 15 is a sectional view showing that the fixing assembly and the pipe connector are untightened in accordance with the second embodiment of the present invention.
Figure 16:
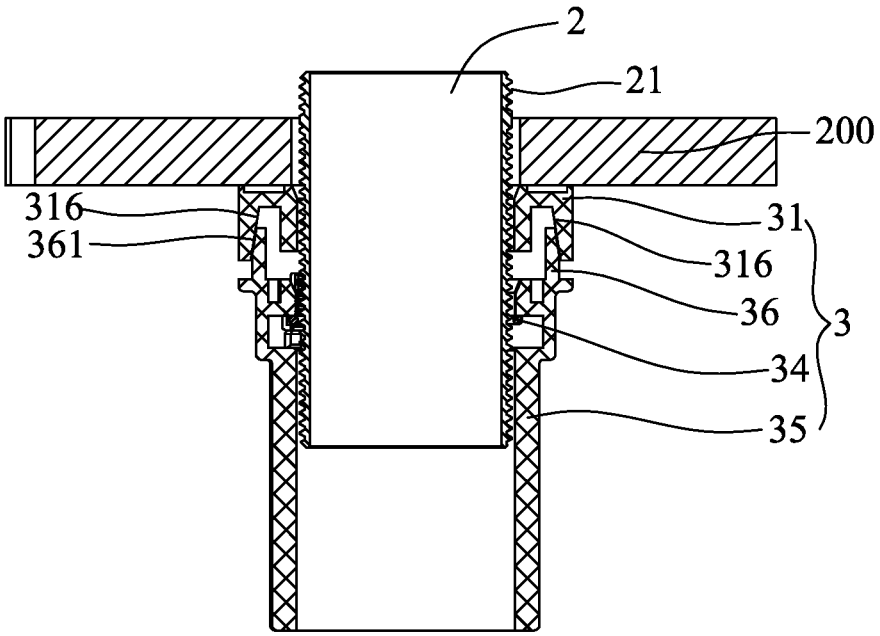
FIG. 16 is a sectional view of FIG. 15 seen in another direction.
Figure 17:
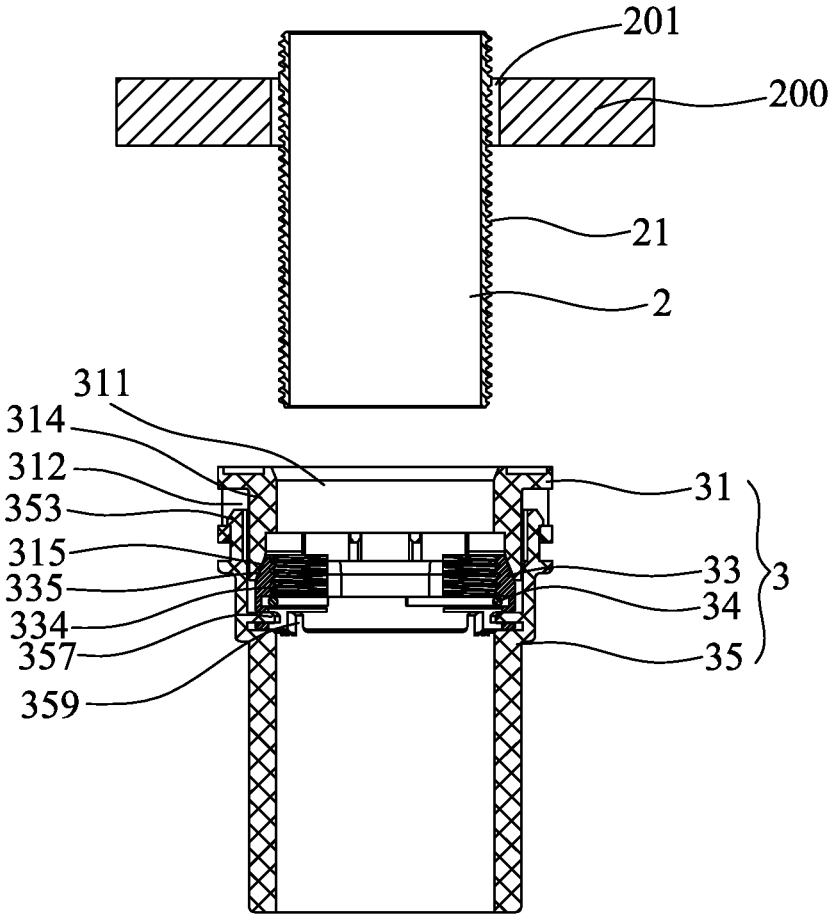
FIG. 17 is a sectional view showing that the fixing assembly is detached from the pipe connector in accordance with the second embodiment of the present invention.

As shown in FIG. 9 to FIG. 17, a second embodiment of the present invention is shown. The second embodiment is substantially similar to the first embodiment with the exceptions described hereinafter. In this embodiment, the return spring 32 is not provided. The stop wall 352 of the lower casing 35 is provided with at least one elastic arm 36. The outer periphery of the top end of the elastic arm 36 is provided with a return inclined surface 361. The bottom surface of the upper casing 31 is provided with an oblique protrusion 316 in cooperation with the return inclined surface 361 of the elastic arm 36. As shown in FIG. 13, when the fixing assembly 3 and the pipe connector 2 are tightened, the upper casing 31 and the lower casing 35 are abutted against each other, so that the elastic arm 36 is deformed to store energy. The return inclined surface 361 of the elastic arm 36 and the oblique protrusion 316 of the upper casing 31 are pressed against each other. As shown in FIG. 16, when disassembled, after the fixing assembly 3 is reversely rotated, the locked state of the press block 33 and the pipe connector 2 is released. Through the elasticity of the elastic arm 36 and the cooperation between the return inclined surface 361 and the oblique protrusion 316, the lower casing 35 is pushed downwards. The press block 33 is released to bounce toward both sides under the action of the return C-shaped ring 34, so that the fixing assembly 3 can be quickly removed to complete the disassembly quickly.

In summary, the present invention achieves rapid assembly and fixation of the fixing assembly 3 and the pipe connector 2 through the cooperation of the upper casing 31, the press block 33 and the lower casing 35, and then uses the cooperation of the return C-shaped ring 34 and the press block 33 to achieve the quick disassembly of the fixing assembly 3 and the pipe connector 2. When assembled, only the fixing assembly 3 needs to be aligned with the pipe connector 2 and the fixing assembly 3 is pushed upwards to reach the countertop 200. The fixing assembly 3 is rotated one turn, so that the fixing assembly 3 and the pipe connector 2 are screwedly connected together. When disassembled, only the fixing assembly 3 needs to be rotated reversely one turn, and the screw connection between the pipe connector 2 and the fixing assembly 3 is released. Under the action of the return C-shaped ring 34, the press block 33 bounces outwards and the fixing assembly 3 can be quickly disassembled. The present invention realizes rapid assembly and disassembly of the faucet body 1 through a simple structure.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A kitchen faucet mounting structure, comprising a faucet body, a pipe connector and a fixing assembly, the faucet body being connected to an upper portion of the pipe connector, a lower portion of the pipe connector having an external thread, characterized by: the fixing assembly including an upper casing, a press block, a return C-shaped ring and a lower casing, the upper casing having a central through hole for the pipe connector to pass therethrough, the upper casing further comprising at least one guide post, the guide post having a first inclined surface; the press block having at least one opening, the press block having an internal thread in cooperation with the external thread of the pipe connector, an upper portion of the press block having a second inclined surface in cooperation with the first inclined surface, the press block further having an annular engaging groove for mounting the return C-shaped ring, an upper portion of the lower casing being provided with a trough extending downwards from a top surface thereof, the press block being mounted in the trough, an inner wall of the trough being provided with at least one engaging post, the press block being provided with a guide hole corresponding to the engaging post.

2. The kitchen faucet mounting structure as claimed in claim 1, wherein a bottom surface of the upper casing is provided with a plurality of limiting ribs, the guide post is disposed between the limiting ribs and the through hole, a top end of the lower casing is provided with at least one guide protrusion, and a top end of the guide protrusion is inserted between two of the limiting ribs on the bottom surface of the upper casing.

3. The kitchen faucet mounting structure as claimed in claim 1, wherein the upper casing has at least two engaging slots, and a top end of the lower casing is provided with engaging hooks in cooperation with the engaging slots.

4. The kitchen faucet mounting structure as claimed in claim 1, wherein the fixing assembly further comprises a return spring, one end of the return spring leans against a bottom end of the upper casing, and another end of the return spring leans against the lower casing.

5. The kitchen faucet mounting structure as claimed in claim 1, wherein a top end of the lower casing is provided with at least one elastic arm, an outer periphery of a top end of the elastic arm has a return inclined surface, and the upper casing is provided with an oblique protrusion in cooperation with the return inclined surface of the elastic arm.

6. The kitchen faucet mounting structure as claimed in claim 1, wherein the trough of the lower casing is provided with at least one boss corresponding to the opening of the press block, and the boss has guide surfaces toward two sides of the press block.

7. The kitchen faucet mounting structure as claimed in claim 1, wherein a bottom end of the press block has at least one L-shaped guide notch, and the trough of the lower casing is provided with at least one guide raised block corresponding to the guide notch of the press block.

8. The kitchen faucet mounting structure as claimed in claim 1, wherein the press block has two openings, the two openings divide the press block into a left press block and a right press block, and each of the left press block and the right press block is provided with the guide hole.

9. The kitchen faucet mounting structure as claimed in claim 3, wherein the top end of the lower casing has a stop wall in cooperation with a bottom surface of the upper casing, the stop wall is provided with the engaging hooks corresponding in position to the engaging slots of the upper casing, and the engaging slots each have a certain height so that the locking hooks can move up and down within the respective engaging locking slots.

10. The kitchen faucet mounting structure as claimed in claim 1, wherein the first inclined surface of the guide post is gradually enlarged downwards and outwards from one side of the through hole, and the second inclined surface of the press block is gradually tapered from an outer periphery of the upper portion of the press block.

* * * * *